United States Patent [19]

Walker, Jr.

[11] 4,309,910

[45] Jan. 12, 1982

[54] STRING TENSION TESTER

[76] Inventor: Frank A. Walker, Jr., 20292 Bancroft Cir., Huntington Beach, Calif. 92646

[21] Appl. No.: 108,352

[22] Filed: Dec. 31, 1979

[51] Int. Cl.[3] ..... G01L 5/06

[52] U.S. Cl. ..... 73/862.46

[58] Field of Search ..... 73/144, 145, 139, 862.46

[56] References Cited

U.S. PATENT DOCUMENTS

| | | | |
|---|---|---|---|
| 2,352,730 | 7/1944 | Miessner . | |
| 2,400,978 | 5/1946 | Collins | 73/139 |
| 2,461,491 | 2/1949 | Booth | 73/139 |
| 3,831,442 | 8/1974 | Cummins et al. | 73/144 |

*Primary Examiner*—Charles A. Ruehl

*Attorney, Agent, or Firm*—Poms, Smith, Lande & Rose

[57] ABSTRACT

A simple and inexpensive testing device for checking the tension of the strings of a tennis racquet, a badminton racquet or the like includes a string engaging member for engaging one of the strings of a previously strung racquet. This string engaging member may be bifurcated and be secured to a cylindrical block which is rotatably mounted in the front of a rigid elongated handle. A torsion element is mounted between the block and the rear of the handle, so that when the handle is rotated, and the torsion element is stressed, the handle will rotate relative to the block which is engaging the strings, and the amount of rotation of the handle relative to the block will be an indication of the tension of the strings. In addition, arrangements are provided for indicating that the string engaging member secured to the cylindrical block has been rotated through a predetermined angle. It is convenient to have a disk secured to the cylindrical block, with the disk being notched to indicate rotation through a predetermined angle, when the notch lines up with the strings in the racquet. In addition, the disk may be provided with a scale, and a pointer secured to the front end of the elongated handle and overlying the scale will indicate the number of pounds of tension in the strings, when the handle is rotated so that the notch previously mentioned lines up with the string.

11 Claims, 4 Drawing Figures

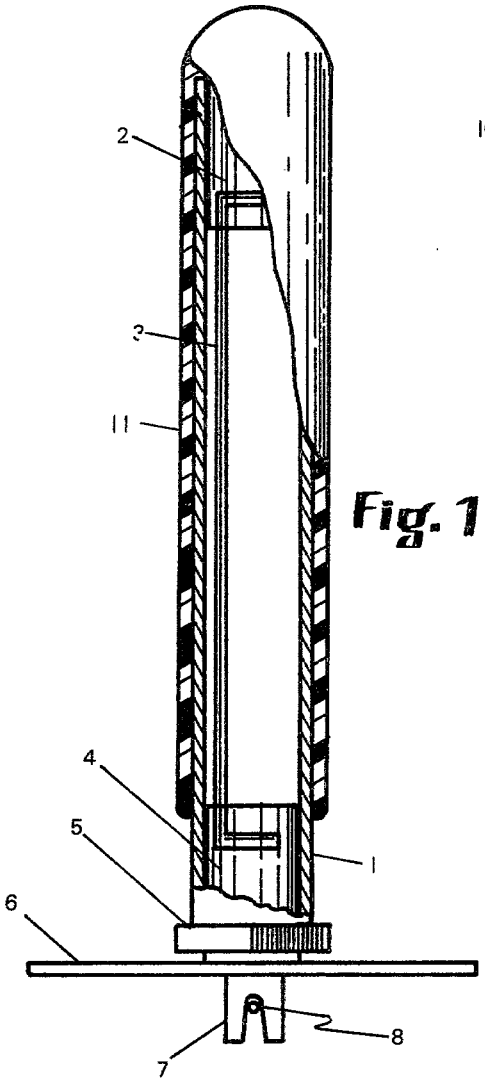
Fig. 1
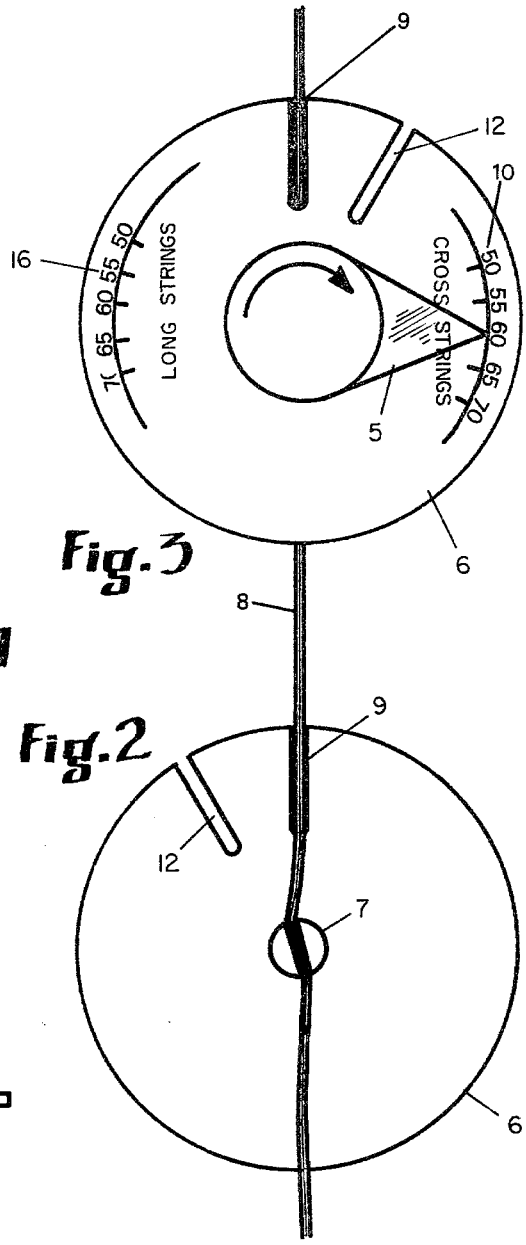
Fig. 3
Fig. 2
Fig. 4
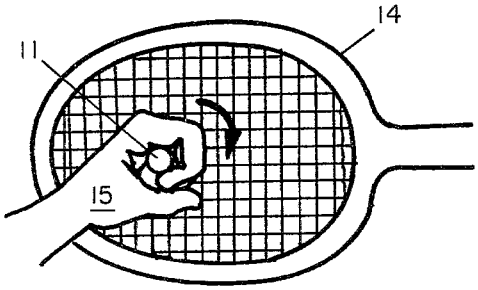

STRING TENSION TESTER

FIELD OF THE INVENTION

This invention relates to devices for testing the tension of strings, wires, or other lines.

BACKGROUND OF THE INVENTION

There are many devices available to properly tension a sports racquet, such as a tennis, badminton, or squash racquet, during the stringing process. These devices are accurate and reliable, and are necessary for consistent racquet stringing. However, once the racquet is strung, there is no readily available method or device for accurately checking the racquet string tension. Present practice consists of thumping the racquet face against the heel of the hand, or flicking the strings with the fingertips, in order to audibly determine the frequency of the "twang" or "singing" of the strings, as an indication of tension. Another method which is sometimes employed is to displace the strings by pushing on the racquet face and subjectively estimating tension.

There is obviously a need for accurate measurement of the tension of the strings in a sports racquet to ascertain whether the strings have gone slack, have changed tension over a period of time, and to check to see if a freshly strung racquet is strung consistently and throughout its surface at the prescribed tension.

Accordingly, the principal object of the present invention is to provide a simple and inexpensive apparatus for checking the tension of lines under tension, and particularly for checking the tension of strings in a sports racquet.

SUMMARY OF THE INVENTION

In accordance with a broad aspect of the invention, the tension testing device or assembly includes two members which are rotatable relative to one another, with one of these elements being a handle, and the other being a cylindrical block which is provided with a pair of fixed extending prongs forming a preferably V-shaped member, for engaging the line or string to be tested. A torsion spring or other resilient element is connected between the two members to provide a normal neutral position, but permitting relative rotation of the two members when force is applied to them. In practice, the handle is rotated so that the V-shaped member engages the strings, and the two members rotate relative to one another as force is applied from the handle through the torsion spring or other resilient element to rotate the cylindrical block on which the string engaging member is mounted. When the string engaging member has been rotated through a predetermined angle, or when a predetermined amount of force has been applied to the strings, a scale is read which indicates the tension in the strings.

In one specific illustrative embodiment of the invention, the cylindrical block which carries the string-engaging member is provided with a disk which is notched and which has one or more scales calibrated to indicate string tension. A pointer is secured to the front of the handle and overlies the scale. In practice, the handle is turned until the strings line up with one of the notches, and then the approximate string tension is read from the position of the pointer with respect to the scale.

Instead of rotating the string engaging member through a predetermined angle, the apparatus may be arranged to apply a predetermined force or torque to the strings and the scale may be read through alignment with the strings indicating the angle of rotation of the string engaging member when a fixed amount of force or torque is applied to rotate the string engaging member. Each of these techniques will give repeatable tension readings.

More than one scale may also be provided, with the different scales referring to different types of strings, such as nylon or gut, or to different length strings, for specific examples.

Other objects, features, and advantages of the invention will become apparent from a consideration of the following detailed description and from the accompanying drawings.

BRIEF DESCRIPTION OF THE DRAWINGS

FIG. 1 is a partial cross-sectional view of a tension testing assembly illustrating the principles of the invention;

FIG. 2 is a view of the device in operation taken from the bottom of the unit as shown in FIG. 1;

FIG. 3 is a view of the unit in operation taken from the top, with reference to FIG. 1; and FIG. 4 is an overall view of the unit as it would be used by an individual in the testing of the strings of a tennis racquet.

DETAILED DESCRIPTION

Referring more particularly to the drawings, in the partial cross-sectional view of FIG. 1, the tubular handle member 1 may be formed of aluminum, for example, and is provided with an outer grip 11 of plastic or rubber, and has a pointer 5 secured to its lower end, as shown in FIG. 1. Journalled in the lower end of the tubular 1 is a cylindrical block 4 to which the string engaging member 7 is secured. The string engaging member 7 is bifurcated and includes the two fixed spaced prongs which extend over the string 8 to be tested when the assembly is used.

The upper end of the tubular handle 1 is coupled through the fixed block 2 and the torsion spring 3 to the lower cylindrical block 4. The torsion spring 3 may, for example, be a length of spring steel wire 1/16th inch in diameter. It may be secured to the rear block 2 and to the front cylindrical block 4 by any suitable means, such as by deformation of plastic material in grooves to hold the wire 3 in place. Although a single off-center wire 3 is shown, it is understood that two such wires may be employed, or a thinner lightweight sheet metal element could interconnect the rear block 2 and the cylindrical front block 4 to provide the resilient interconnection.

Secured to the block 4 and rotatable with the string engaging member 7 is a disk 6 which is provided with two slots 9 and 12, as better shown in FIGS. 2 and 3, and which are located on either side of an extension of the line extending through the slot of the string engaging member 7.

To better understand the operation of the device, attention is directed to FIGS. 2 and 3, which are bottom and top views, respectively, of the unit of FIG. 1. In operation, the slot of the string engaging member 7 is placed over one of the strings 8 in the vicinity of the "sweet spot" or central area of the racquet. Before any rotational force is applied to the grip 11 on the tubular handle 1, the disk 6 is in a neutral position, and is oriented relative to the string 8 so that the string precisely bisects the angle between the slots 9 and 12. Then, when it is desired to determine the tension, the grip 11 is rotated until the string 8 lines up with one of the slots 9 or 12. The action in rotating the grip 11 to turn the string engaging member 7 will cause deflection of the resilient element 3, and the pointer 5 which is secured to the front end of the handle 1 and which overlies the scale 10, will rotate to point to a specific value of tension on the scale 10. As indicated in FIG. 3, the tension of the string in the particular racquet being tested is 60 pounds tension.

FIG. 4 is a top view showing the head 14 of a tennis racquet and the upper end of the grip 11 being rotated by the hand 15 of a tennis player.

Referring back to FIG. 3, it may be noted that the angular spacing of the scale 16 from the slot 12 is slightly greater than the spacing of the scale 10 from the slot 9. This is to accommodate different racquet string conditions, and the scale 16 may give the high end of the tension scale, while the scale 10 may give the low end of the tension scale. The various factors which can affect the reading include the distance between the points of suspension or rigid securing of the string in place, and whether nylon or gut strings are employed, for example. The tension of the strings may also depend on the order of stringing the strings. For example, if one set of strings, such as the longer longitudinal strings are strung first, and the cross strings are strung later, the cross-stringing will increase the tension of the original set of strings. Under these circumstances, the tension of the cross strings should be read on scale 10 in FIG. 3, and the original tension of the longer strings would be read on scale 16. In actual usage, however, the user of the racquet is primarily interested in changes in tension which may occur over time, and to be able to determine whether each of two racquets has the same tension in the stringing. Accordingly, the relative readings are more important than the absolute measure of tension, and the changes from the desired reading are also of primary significance. It is also important that the same set of strings is always checked on the same scale, and for this reason scale 10 is labelled "cross strings" and scale 16 is labelled "long strings".

Incidentally, the operation of the present string tester is enhanced by the configuration of the string engaging member 7 which includes two spaced prongs or elements which are fixedly spaced apart, have a V-shaped cross section, and which extend along the string for a distance which is several times the spacing between the elements where they engage the string.

In the introduction of the present specification mention was made of apparatus or tools for stringing tennis racquets, and one such arrangement is shown in B. F. Miessner U.S. Pat. No. 2,352,730, granted July 4, 1944. While the Miessner patent does show a scale arrangement for determining string tension, it is only intended for use while the unit is being employed to string a racquet with one end of the string secured and the other end wrapped around a spool on the device; accordingly, the Miessner device like others which are known, does not solve the problem of testing string tension after the racquet is completely strung.

In closing, it is to be understood that the present invention is not limited to that precisely as disclosed hereinabove. Thus, in the described arrangements, the string engaging member was rotated through a predetermined angle and then the rotation of the handle relative to the string engaging member was read from a scale; instead, the pointer could be rotated to a predetermined fixed level of torsion between the handle and the string engaging member, and a scale could be provided in the vicinity of the present location of slot 9, which could indicate string tension in terms of the angular position of the periphery of disk 6 relative to the orientation of the string 8. Also, instead of pointer 5, a second disk having a window, or suitable transparent plastic indicator elements, could be employed. Further, instead of the elongated tubular handle 1 and grip 11, a more compact handle extending to one side, with a different type of resilient element could be employed. Accordingly, the present invention is not limited to that precisely as illustrated and described in the foregoing detailed description.

What is claimed is:

1. A sports racquet string tension tester comprising:

an elongated hollow handle, having a front and a rear end, said handle having a circular opening at the front end thereof;

a torsion spring mounted within said handle and having one end secured to the rear of said handle;

a cylindrical block rotatably mounted in said circular opening at the front end of said handle, said torsion spring being secured at its other end to said cylindrical block;

V-shaped means secured to the outer end of said cylindrical block, for firmly engaging strings of different thicknesses without lost motion; and means secured to said front end of said handle and to said block for indicating the tension of the strings in said sports racquet when said V-shaped string engaging means is engaged with the strings, and the handle is rotated;

whereby the firm engagement of strings of any thickness prevents lost motion and resultant errors as the handle is rotated.

2. A sports racquet string tension tester as defined in claim 1 wherein said block has a neutral orientation position; and wherein said indicating means includes means for indicating rotation of said block by a predetermined angle and two differently spaced scale means for indicating the tension of the string when said handle is rotated in one direction or the other so that said block has changed orientation by said predetermined angle; whereby tension of either the long or the short strings of the racquet may be selectively tested by rotating the handle in one direction or the other.

3. A sports racquet string tension tester as defined in claim 2 wherein said scale means is secured to said block, and wherein said means secured to the front of said handle overlies said scale to indicate the string tension.

4. A sports racquet string tension tester as defined in claim 2 wherein said means for indicating rotation of said block by a predetermined angle is an angular indication means mounted on said cylindrical block.

5. A sports racquet string tension tester as defined in claim 3 wherein said means for indicating rotation of said block by a predetermined angle includes at least one opening in said scale means oriented for alignment with the strings of said racquet when the block is rotated through said predetermined angle.

6. A sports racquet string tension tester is defined in claim 3 wherein said means secured to the front of said handle is a pointer overlying said scale.

7. A sports racquet string tension tester as defined in claim 1 wherein said V-shaped string engaging means includes two elements fixedly spaced apart from one another and extending along said string for a distance at least equal to several times the spacing between said elements.

8. A tension tester as defined in claim 1 wherein said indicating means includes separate means having differently spaced scale indications for indicating tension when said handle is rotated in one direction and in the other direction, respectively.

9. A consistent and reliable sports racquet string tension tester comprising:

an elongated hollow handle, having a front and a rear end, said handle having a circular opening at the front end thereof;

a metal torsion rod mounted within said handle and having one end secured to the rear of said handle;

a cylindrical block rotatably mounted in said circular opening at the front end of said handle, said torsion rod being secured at its other end to said cylindrical block;

bifurcated string engaging means secured to the outer end of said cylindrical block, said string engaging means being provided with a V-shaped recess for engaging racquet strings without lost motion during testing;

first means secured to said front end of said handle and to said block for indicating the tension of the strings in said sports racquet when said bifurcated string engaging means is engaged with the strings, and the handle is rotated in one direction;

second means secured to said block for providing a different indication of the tension in said strings when said handle is rotated in the opposite direction; and means for uniquely identifying said first and second indicating means;

whereby said racquet tester provides reliable and consistent readings despite changes in temperature, the thickness of strings, or when using the longer longitudinal strings or the shorter transverse strings of a racquet.

10. An inexpensive and consistent sports racquet string tester as defined in claim 9 wherein said metal torsion rod is a simple wire mounted off-center within said handle and with its two ends bent for securing in said handle and said block, respectively.

11. A consistent and economical sports racquet string tension tester comprising:

an elongated hollow handle, having a front and a rear end, said handle having a circular opening at the front end thereof;

a metal torsion rod mounted within said handle and having one end secured to the rear of said handle;

a cylindrical block rotatably mounted in said circular opening at the front end of said handle, said torsion rod being secured at its other end to said cylindrical block;

said metal torsion rod being a simple wire mounted offcenter within said handle and with its two ends bent for securing in said handle and said block, respectively;

bifurcated string engaging means secured to the outer end of said cylindrical block;

first means secured to said front end of said handle and to said block for indicating the tension of the strings in said sports racquet when said bifurcated string engaging means is engaged with the strings, and the handle is rotated in one direction;

second means secured to said block for providing a different indication of the tension in said strings when said handle is rotated in the opposite direction; and means for uniquely identifying said first and second indicating means;

whereby said racquet tester provides reliable and consistent readings despite changes in temperature, or when using the longer longitudinal strings or the shorter transverse strings of a racquet.

* * * * *